United States Patent [19]

Culling

[11] 4,088,478

[45] May 9, 1978

[54] CORROSION-RESISTANT ALLOYS

[75] Inventor: John H. Culling, Kirkwood, Mo.

[73] Assignee: Carondelet Foundry Company, St. Louis, Mo.

[21] Appl. No.: 751,039

[22] Filed: Dec. 16, 1976

Related U.S. Application Data

[63] Continuation of Ser. No. 463,886, Apr. 24, 1974, abandoned, which is a continuation-in-part of Ser. No. 346,693, Mar. 30, 1973, abandoned, which is a continuation-in-part of Ser. No. 137,641, Apr. 26, 1971, abandoned.

[51] Int. Cl.[2] ..... C22C 30/02

[52] U.S. Cl. ..... 75/134 C; 75/134 F

[58] Field of Search ..... 75/122, 125, 128 R, 75/128 W, 134 F, 171, 134 C

[56] References Cited

U.S. PATENT DOCUMENTS

| | | | |
|---|---|---|---|
| 2,777,766 | 1/1957 | Binder | 75/122 |
| 3,044,871 | 7/1962 | Mott | 75/125 |
| 3,048,485 | 8/1962 | Bieber | 75/125 |
| 3,495,977 | 2/1970 | Denhard et al. | 75/128 R |
| 3,547,625 | 12/1970 | Bieber et al. | 75/128 W |
| 3,552,950 | 1/1971 | Rundell et al. | 75/122 |
| 3,759,704 | 9/1973 | Culling | 75/122 |
| 3,813,239 | 5/1974 | Flint et al. | 75/122 |
| 3,930,904 | 1/1976 | Eiselstein et al. | 75/134 F |

*Primary Examiner*—Arthur J. Steiner

*Attorney, Agent, or Firm*—Koenig, Senniger, Powers and Leavitt

[57] ABSTRACT

An air-meltable castable alloy, resistant to corrosion by sulfuric acid over a wide range of acid strengths and degrees of contamination. As essential constituents, the alloy contains between about 34.10 and about 39.33% by weight nickel, between about 12.50 and about 14.29% by weight chromium, between about 5.90 and about 17.89% by weight molybdenum, between about 2.90 and about 5.67% by weight copper, between about 0.10 and about 1.25% by weight silicon, between about 0.003 and about 0.15% by weight carbon, and between about 22 and about 29% by weight iron. It may also contain up to about 3.0% by weight manganese, up to about 9.80% by weight tungsten, up to about 4.68% by weight tantalum, and up to about 3.00% by weight niobium.

4 Claims, No Drawings

CORROSION-RESISTANT ALLOYS

CROSS-REFERENCE TO RELATED APPLICATIONS

This is a continuation of Application Ser. No. 463,886, filed Apr. 24, 1974, which was a continuation-in-part of application Ser. No. 346,693, filed Nov. 30, 1973, which was a continuation-in-part of Ser. No. 137,641 filed Apr. 26, 1971 all of which are now abandoned.

BACKGROUND OF THE INVENTION

This invention relates to the field of alloys and more particularly to certain alloys which are resistant to corrosion in contaminated or uncontaminated sulfuric acid over a wide range of acid strengths.

For purposes of analyzing and predicting their corrosive effect on various metals, acids and other corrosive agents are commonly classified as either "oxidizing" or "reducing". A reducing medium is one which includes no component more oxidizing than the hydrogen ion or hydronium ion. Sulfuric acid is normally a reducing medium, as are hydrochloric acid, acetic acid, phosphoric acid, aluminum chloride, hydrobromic acid and hydrofluoric acid. Oxidizing media are those which include a component which is more oxidizing than the hydrogen ion or hydronium ion. Typical oxidizing media include nitric acid, hydrogen peroxide, ferric sulfate, silver nitrate, potassium nitrate, sodium nitrate, copper sulfate, potassium permanganate, sodium dichromate, chromic acid, calcium chloride, mercuric chloride, aqua regia, sodium hypochlorite, ferric chloride and cupric chloride.

The corrosion resistance of a given metal or alloy in a reducing medium is often sharply different from its resistance in an oxidizing medium, with some metals and alloys being more resistant to reducing media and others to oxidizing media. These differences in behavior are thought to be attributable to differences between the corrosion mechanism in reducing media and the corrosion mechanism in oxidizing media. Thus, corrosive attack by a reducing acid is generally considered to involve attack on the metal by hydrogen ions, resulting in oxidation of the metal to soluble ions and release of hydrogen gas. Thus, metals of relatively high nobility, as indicated by their positions in the galvanic series, are generally resistant to corrosion by reducing acids. Attack by oxidizing media, on the other hand, does not involve release of hydrogen but commonly results in the formation of metal oxides or other metallic compounds at the metal surface. Unlike the usual situation with reducing acids, a favorable position relative to hydrogen in the electromotive series provides no insurance that a metal will not be rapidly attacked by oxidizing media. However, certain elements such as chromium, aluminum and silicon form tough insoluble oxide films on initial contact with an oxidizing medium which serve as barriers against further reaction between the medium and the metal and thus prevent further corrosion from taking place.

There are a number of relatively expensive metals, for example, tungsten and tantalum, which exhibit a high resistance to corrosion in either a reducing or an oxidizing medium. However, many of the metals which are more commonly used for corrosion resistance in the reducing media, such as molybdenum and copper, are not particularly resistant to oxidizing media while the metals which are commonly used to impart resistance to oxidizing media, such as chromium, are rapidly attacked in various reducing media. For these reasons, many industrial alloys are designed for use in only one type of medium and often fail catastrophically when exposed to the other type.

Sulfuric acid is normally a reducing acid. High strength sulfuric acid, however, is often oxidizing, especially at elevated temperatures. Moreover, various industrial sulfuric acid streams contain various oxidizing acids and salts as contaminants. It is therefore desirable that an alloy designed for general utility in industrial sulfuric acid streams by resistant to both reducing and moderately oxidizing environments. To develop an alloy which is resistant to corrosion in sulfuric acid over a wide range of concentrations, however, it is not sufficient to provide resistance under the reducing conditions presented by dilute acid and the oxidizing conditions presented by concentrated acid. For many alloys, acids in the intermediate concentration range of 30–80% are more corrosive than either very concentrated or very dilute acid. The range of 60–70%, which is quite commonly encountered in various industrial processes, often results in particularly high rates of corrosion. Few commercial alloys are available which exhibit high resistance throughout the middle range of acid concentration and at the ends of the concentration range as well.

Commercially available alloys which have found use in sulfuric acid service are mostly nickel base alloys containing varying amounts of chromium, molybdenum, copper, silicon and manganese. As is generally the case in alloying practice, these alloys also contain the maximum amount of iron consistent with retention of reasonably good anticorrosive properties. In most of the alloy formulations which have been heretofore considered suitable for sulfuric acid service, particularly under severe conditions, the maximum allowable iron content has not been high. The sum of proportions of "critical elements" such as nickel, chromium, molybdenum and copper has normally been too great to allow the use of ferro alloys in alloy formulation. Those few sulfuric acid-resistant alloys whose critical metal content has been relatively low have typically included at least 18% by weight chromium. An exception to this general proposition is found in the existence of various iron/silicon alloys such as that sold under the trade designation "Duriron" by the Duriron Company. However, iron/silicon alloys, while possessed of a relatively high degree of corrosion resistance, are hard and brittle and cannot generally be cold-worked.

It is also well-known that, in a particular corrodent, the presence of contaminating chlorides, especially hydrochloric acid, will severly depassivate an alloy that is otherwise normally resistant to that corrodent.

Those skilled in the art of developing and applying alloys in the field of corrosion have for years been aware of the fact that an element which is beneficial to an alloy in one type of service is often detrimental in another type of service. Consequently, a very careful selection and balance of the proportions of elements is required to provide an alloy resistant to different corrosive environments such as those encountered in sulfuric acid solutions at different concentrations and temperatures.

SUMMARY OF THE INVENTION

Among the several objects of the present invention, therefore, may be noted the provision of alloys which are resistant to sulfuric acid over a wide range of concentrations; the provision of such alloys which are resistant to sulfuric acid contaminated with various oxidizing agents and/or chlorides; the provision of such alloys which may be formulated from ferro alloys; the provision of such alloys which are air-meltable; and the provision of such alloys which can be either cast or wrought. Other objects and features will be in part apparent and in part pointed out hereinafter.

Briefly, the present invention is directed to an air-meltable alloy, resistant to corrosion in sulfuric acid over a wide range of acid strengths, consisting essentially of between about 34.10 and 39.33% by weight nickel, between about 12.50 and about 14.29% by weight chromium, between about 5.90 and about 17.89% by weight molybdenum, between about 2.90 and about 5.67% by weight copper, between about 0.10 and about 1.25% by weight silicon, between about 0.003 and about 0.15% by weight carbon, between about 22 and about 29% by weight iron, up to about 3.0% by weight manganese, up to about 9.80% by weight tungsten, up to about 4.68% by weight tantalum, and up to about 3.00% by weight niobium.

DESCRIPTION OF THE PREFERRED EMBODIMENTS

The alloys of the present invention are resistant to corrosion by sulfuric acid over a wide range of acid strengths. In contrast with many commercially available alloys, the alloys of the invention are particularly effective in the middle concentration range of 30–80% $H_2SO_4$, including the frequently very destructive range of 60–70%. These alloys also perform very satisfactorily at elevated temperatures. Thus, at temperatures from room temperature up to about 200° F. or higher, the alloys of the invention suffer corrosion rates which are generally less than 0.050 inches per year (I.P.Y.) generally considered the maximum tolerable rate in the process industries. Though primarily designed for resistance to reducing sulfuric acids, the alloys of the invention include proportions of chromium, iron, molybdenum and nickel which render them quite satisfactory for service in sulfuric acids containing oxidizing contaminants such as nitric acid or other oxidizing acids or salts or chlorides. In particular, they are resistant to corrosion by the mixed sulfuric and nitric acids commonly used as nitrating agents for organic compounds. They also exhibit good resistance to relatively strong nitric acid up to 150° F. or higher and serve well in 10 or 20% hydrochloric acid at room temperature.

The alloys of the invention are air-meltable and possess advantageous mechanical properties which render them suitable as materials of construction for tanks, pressure vessels, pipe, valves, pumps agitators or other equipment which is exposed to sulfuric acid process streams. All of the alloys of the invention may be cast, and certain of these alloys may also be subjected to various hot and cold-working processes.

Unlike many alloys which have previously been available for sulfuric acid service under severe conditions, the alloys of the present invention can be formulated from ferro alloys. The alloys of the invention are further characterized by their relatively low chromium content. Thus, they are relatively low in cost by comparison with many of the alloys which have heretofore been utlized in sulfuric acid service. Despite their lower cost, the alloys of the invention exhibit equivalent or even better corrosion resistance, in many cases, than the various commercially available alloys which have hitherto found substantial use in sulfuric acid service.

The molybdenum and copper contained in the alloys of the invention are believed to interact synergistically to provide especially effective corrosion resistance, even where the "critical element" content is low by comparison to many alloys which find industrial use for their resistance to corrosion by sulfuric acid. Both molybdenum and copper also impart resistance to the depassivating effect of chlorides such as hydrochloric acid. Molybdenum, in particular, cooperates with chromium and nickel to provide resistance to attack by chlorides in the presence of oxidizers such as nitric acid or air.

Although alloys containing up to 16.67% copper are satisfactory for certain services, an upper limit of about 5.67% is now considered essential for the copper content of the alloys of the invention. The substantially enhanced resistance to reducing media and improved fabricability which copper affords are realized without causing the precipitation of a second solid phase and resultant susceptibility to intergranular galvanic attack.

In my parent application Ser. No. 137,641, chromium was considered to be an optional component of the alloys of the invention. For optimum results, however, the presence of at least about 12.5% by weight chromium is important to assure resistance of these alloys to concentrated sulfuric acid at elevated temperatures, as well as in the presence of oxidizing agents. Although alloys containing little or no chromium but otherwise corresponding to those disclosed herein possess good properties for some services, the presence of at least about 12.5% chromium is now considered essential in the alloys of this invention.

Tungsten, tantalum and niobium are optional components of my alloys which may be substituted in part for molybdenum to impart particularly desirable properties to the alloys. While the alloys of this invention normally display good resistance to many solutions containing chlorides (as well as excellent resistance to oxidizing and reducing solutions of sulfuric acid) when the alloys are formulated without inclusion of tungsten and tantalum, those two elements are advantageously substituted in part for molybdenum where particularly severe chloride contamination is anticipated in service. In all cases, however, molbydenum content must be at least about 5.9% by weight. Tungsten, tantalum, and niobium provide resistance to both reducing and oxidizing conditions. Along with molybdenum, they also provide resistance to depassivation by halide ions. Niobium and tantalum stabilize such excess carbon as may be present and thereby prevent intergranular attack on the alloy. A niobium content of about 3.00% by weight and a tantalum content of about 4.68% by weight are especially effective for stablizing carbon. Even where niobium and tantalum are included, however, the carbon content of these alloys is preferably no higher than about 0.15% by weight.

Manganese serves a a deoxidizing agent in the alloys of the invention and the presence of 0.05% by weight or more manganese is useful for this purpose. Up to about 5–6% by weight manganese can be substituted for nickel as an austenitizer without significant deleterious effect. In fact, concentrations as high as 22% by weight manganese could be tolerated without any serious adverse effect on either the corrosion resistance or mechanical properties of these alloys, but the manganese content of the alloys of the invention is preferably maintained at about 3% by weight or less to avoid attack by manganese oxide on the furnace linings or sand molds used in preparing and casting the alloys, respectively.

In my parent application Ser. No. 137,641, it was considered that nickel content could vary between about 22.1 and 52.1% by weight. It has now been discovered that more consistent corrosion resistance is realized where the nickel content is between about 34.10 and about 39.33% by weight. Although alloys containing higher or lower nickel contents but otherwise corresponding to those disclosed herein possess good properties for some services, the presence of between about 34.10 to about 39.33% by weight nickel is now considered essential in the alloys of this invention.

While the optimum composition of these alloys may vary somewhat depending on the particular service for which they are intended, the most preferred alloys of the invention have a silicon content of between about 0.05 and about 1.25% by weight and a carbon content of between about 0.01 and about 0.05% by weight. Additionally, the molybdenum content, tungsten content, tantalum content, and niobium content preferably correspond to the relationships $$X = [Mo] + [W] + [Ta] + [Nb]$$

$$Y = [Mo] + 0.7([W] + [Ta] + [Nb])$$

where

[Mo] = molybdenum content in % by weight
[W] = tungsten content in % by weight
[Ta] = tantalum content in % by weight
[Nb] = niobium content in % by weight X is between about 15 and about 20% and Y is between about 12.5 and about 17.9%. Inclusion of 12.5% or more by weight of chromium provides good resistance to sulfuric acid solutions contaminated with various oxidizing agents without seriously reducing the solubility of copper. Tungsten and tantalum further enhance the resistance of the alloys to oxidizing agents.

Alloys having the most preferred ranges of concentration defined above can be successfully formulated without the necessity of including manganese as a deoxidizing agent. Outside these most preferred ranges, the presence of at least about 0.05% by weight manganese is generally considered essential. It is not necessary in any of my alloys, however, where the silicon content is 0.4% by weight or greater.

The alloys of the invention are prepared by conventional methods of melting and no special requirements such as controlled atmospheres are required. In preparing the alloys, the constituents of a melting furnace charge need not be of any particular type. Thus, raw materials such as remelt scrap materials, copper scrap, ferro alloys such as ferro-silicon and ferro-manganese and other commercial melting alloys may be used.

The following examples illustrate the invention.

EXAMPLE 1

One hundred pound heats of twenty-five different alloys were prepared by dead melting in a 100-pound high frequency induction furnace. The compositions of these alloys are set forth in Table 1, with the balance in each instance being essentially iron. Alloy No. 4, Alloy No. 14 and Alloy No. 24 in Table 1 are alloys of this invention. Table 1 also sets forth the composition of related alloys produced in development of the alloys of this invention, but which suffer reduced corrosion resistance in one or more concentrations of solutions in which the alloys of this invention demonstrate more versatile corrosion resistance properties.

TABLE 1

| | PERCENTAGE BY WEIGHT OF ALLOYING ELEMENTS* | | | | | | | | | | | | | |
|---|---|---|---|---|---|---|---|---|---|---|---|---|---|---|
| Alloy No. | C | Si | Mn | Ni | Cr | Mo | Cu | W | Ta | Co | Nb | V | Mo + 0.7(W + Ta + Nb) | Fe |
| 1 | 0.05 | 3.37 | — | 22.15 | 12.67 | 8.00 | 5.85 | — | — | — | — | — | 8.00 | 47.91 |
| 2 | 0.13 | 0.76 | — | 24.60 | 13.11 | 6.86 | 5.83 | — | — | — | — | 5.05 | 6.86 | 48.71 |
| 3 | 0.05 | 0.52 | — | 22.48 | 11.27 | 9.42 | 6.00 | 5.08 | 1.53 | — | — | — | 14.04 | 43.65 |
| 4 | 0.05 | 0.49 | — | 38.08 | 14.29 | 5.90 | 2.90 | 4.74 | 4.68 | — | — | — | 12.50 | 28.86 |
| 5 | 0.04 | 0.10 | 0.23 | 29.69 | 9.17 | 7.01 | 6.15 | 4.89 | — | 7.12 | — | — | 10.43 | 35.60 |
| 6 | 0.05 | 3.34 | — | 37.94 | 10.35 | 7.18 | 5.98 | 5.16 | — | — | — | — | 10.79 | 30.00 |
| 7 | 0.02 | 0.21 | 0.05 | 39.37 | 8.9 | 9.34 | 6.05 | 10.02 | — | — | — | — | 16.35 | 26.04 |
| 8 | 0.06 | 3.90 | 3.00 | 33.56 | 8.07 | 5.77 | 5.95 | 5.22 | — | 5.05 | — | — | 9.42 | 29.42 |
| 9 | 0.04 | 0.27 | 0.06 | 29.58 | 4.85 | 8.22 | 9.18 | — | — | — | — | — | 8.22 | 47.80 |
| 10 | 0.06 | 2.92 | 0.15 | 25.80 | 4.27 | 4.77 | 3.70 | 4.72 | — | 4.63 | — | — | 8.07 | 48.98 |
| 11 | 0.02 | 0.98 | 0.25 | 48.86 | 7.51 | 14.67 | 7.48 | 3.75 | — | — | — | — | 17.30 | 16.48 |
| 12 | 0.02 | 1.23 | 0.10 | 31.37 | 13.52 | 6.30 | 5.16 | 5.19 | 5.05 | — | — | — | 13.47 | 32.06 |
| 13 | 0.01 | 1.28 | 0.18 | 32.91 | 12.80 | 4.79 | 4.92 | 14.10 | — | — | — | — | 14.65 | 29.01 |
| 14 | 0.003 | 1.09 | 0.33 | 39.33 | 13.10 | 10.31 | 3.90 | 9.80 | — | — | — | — | 17.17 | 22.14 |
| 15 | 0.08 | 0.71 | 0.71 | 50.2 | 14.18 | 15.40 | 8.35 | 4.10 | — | 1.48 | — | — | 18.27 | 4.79 |
| 16 | 0.06 | 0.60 | 0.69 | 49.1 | 13.30 | 14.92 | 10.83 | 4.00 | — | 1.45 | — | — | 17.72 | 5.05 |
| 17 | 0.07 | 0.72 | 0.67 | 47.1 | 12.56 | 14.10 | 14.21 | 3.72 | — | 1.41 | — | — | 16.70 | 5.44 |
| 18 | 0.07 | 0.61 | 0.66 | 46.0 | 11.58 | 13.55 | 16.67 | 3.70 | — | 1.38 | — | — | 16.14 | 5.78 |
| 19 | 0.05 | 0.49 | 0.50 | 52.1 | 9.35 | 9.86 | 9.64 | 2.49 | — | 11.44 | 0.63 | — | 12.04 | 3.45 |
| 20 | 0.04 | 0.50 | 0.47 | 36.17 | 12.50 | 12.48 | 9.66 | — | — | — | — | — | 12.50 | 28.18 |
| 21 | 0.05 | 0.49 | 0.37 | 33.36 | 4.39 | 10.85 | 10.62 | — | — | — | — | — | 10.85 | 39.87 |
| 22 | 0.04 | 0.49 | 0.26 | 36.58 | — | 11.99 | 11.82 | — | — | — | — | — | 11.99 | 38.82 |
| 23 | 0.04 | 0.75 | 0.43 | 41.80 | 12.53 | 12.14 | 6.76 | 6.85 | — | 5.97 | — | — | 16.94 | 12.82 |
| 24 | 0.04 | 0.63 | 0.43 | 34.10 | 12.80 | 17.89 | 5.67 | — | — | — | — | — | 17.89 | 28.44 |
| 25 | — | — | — | 31 | 13.5 | 6.3 | 5.2 | 5.2 | 5.1 | — | — | — | 13.51 | 32.55 |

*the balance, in each case, is essentially iron

Two standard physical test blocks and three corrosion test bars were prepared from each heat. One of the physical test blocks from each alloy was solution-annealed at 1950° F. for three hours and then oil-quenched. The physical properties of the alloys, in both the annealed and as-cast state, were measured. The as-cast physical properties of a representative number of these alloys are set forth in Table 2 and the physical properties of the same alloys after annealing are set forth in Table 3.

TABLE 2

| PHYSICAL PROPERTIES OF ALLOYS, AS-CAST | | | | |
|---|---|---|---|---|
| Alloy | Yield Strength (PSI) | Tensile Strength (PSI) | Elongation (%) | Brinell Hardness |
| 1 | 38,665 | 57,570 | 10.5 | — |
| 2 | 40,440 | 58,910 | 0.5 | — |
| 3 | 47,300 | 57,860 | 0.5 | — |
| 4 | 37,746 | 62,152 | 12.0 | 170 |
| 5 | 30,000 | 69,000 | 42.5 | — |
| 6 | 43,660 | 59,200 | 6.0 | — |
| 7 | 30,460 | 57,950 | 20.0 | 143 |
| 8 | 34,285 | 60,275 | 21 | 170 |
| 9 | 29,090 | 31,450 | 5.0 | 128 |
| 10 | 30,980 | 57,880 | 19.5 | 143 |
| 11 | 40,463 | 65,040 | 14.0 | 183 |
| 12 | 39,276 | 57,947 | 5.5 | 179 |
| 13 | 41,116 | 50,538 | 5.0 | 167 |
| 14 | 44,483 | 61,033 | 4.0 | 201 |
| 20 | 34,310 | 50,600 | 6.5 | 141 |
| 21 | 29,570 | 43,310 | 8.0 | 187 |
| 22 | 28,990 | 42,070 | 7.0 | 155 |
| 23 | 39,640 | 60,910 | 13.0 | 204 |
| 24 | 44,230 | 60,810 | 11.0 | 156 |

TABLE 3

| PHYSICAL PROPERTIES OF ALLOYS, AFTER SOLUTION ANNEALING | | | | |
|---|---|---|---|---|
| Alloy | Yield Strength (PSI) | Tensile Strength (PSI) | Elongation (%) | Brinell Hardness |
| 1 | 54,545 | 77,027 | 2.5 | 235 |
| 2 | 37,297 | 59,090 | 3.5 | 197 |
| 3 | 66,571 | 81,061 | 1.5 | 255 |
| 4 | 35,372 | 63,517 | 13.0 | 179 |
| 5 | 36,842 | 86,842 | 22.0 | 174 |
| 6 | 62,164 | 78,132 | 1.5 | 255 |
| 7 | 38,192 | 76,635 | 8.5 | 217 |
| 8 | 51,616 | 74,216 | 3.0 | 223 |
| 9 | 28,232 | 62,654 | 22.0 | 137 |
| 10 | 37,592 | 77,142 | 22.5 | 207 |
| 11 | 47,928 | 86,370 | 5.5 | 241 |
| 12 | 46,656 | 73,303 | 2.0 | 229 |
| 13 | 61,864 | 80,414 | 1.0 | 285 |
| 14 | 60,063 | 81,336 | 1.0 | 269 |
| 20 | 44,630 | 77,840 | 3.5 | 187 |
| 21 | 42,650 | 72,150 | 3.5 | 185 |
| 22 | 32,270 | 70,320 | 9.5 | 164 |
| 23 | 51,730 | 86,050 | 3.0 | 229 |

TABLE 3-continued

| PHYSICAL PROPERTIES OF ALLOYS, AFTER SOLUTION ANNEALING | | | | |
|---|---|---|---|---|
| Alloy | Yield Strength (PSI) | Tensile Strength (PSI) | Elongation (%) | Brinell Hardness |
| 24 | 31,650 | 63,110 | 30.0 | 143 |

The corrosion test bars were also annealed for 30 minutes at 1950° F. and oil-quenched prior to machining into 1½ inch diameter × ¼ inch high discs having a one-eighth inch diameter hole in the center. Care was exercised during mechining to obtain an extremely smooth surface on the disc. Twelve to fourteen discs were obtained for each alloy.

These discs were used in the comparative corrosion tests described hereinafter comparing the performance of the alloys of the invention with a number of commercially available alloys. The compositions of the commercially available alloys which were used in these tests and the respective trade designations under which they are marketed are set forth in Table 4.

TABLE 4

| COMMERCIAL ALLOYS UTILIZED IN COMPARATIVE CORROSION TESTS | | | | | | | | | | | |
|---|---|---|---|---|---|---|---|---|---|---|---|
| | Ni | Cr | Mo | Cu | Si | W | C | Mn | Co | Fe | Others |
| Durimet 20 | 29 | 20 | 2.5 | 3.5 | 1.0 | — | 0.05 | 1.00 | — | 42.95 | |
| Hastelloy A | 58 | — | 22 | — | 0.70 | — | 0.08 | 1.00 | 2 | 16.22 | |
| Hastelloy B | 61 | — | 30 | — | 0.70 | — | 0.04 | 0.70 | 2 | 5.56 | |
| Hastelloy C | 55 | 16 | 17 | — | 0.70 | 4.5 | 0.11 | 0.70 | 1.5 | 4.49 | |
| Hastelloy D | 82 | — | — | 3 | 9.0 | — | 0.10 | 1.00 | 1 | 3.90 | |
| Hastelloy F | 48 | 22 | 7 | — | 0.50 | — | 0.04 | 1.50 | 2 | 16.96 | 2 Ta + Cb |
| Hastelloy N | 70 | 7 | 17 | — | 0.50 | — | 0.05 | 0.70 | 2 | 2.75 | |
| Hastelloy W | 63 | 5 | 24 | — | 0.50 | — | 0.12 | 0.70 | 2 | 4.68 | |
| Illium B | 47 | 28 | 8.5 | 5.5 | 5.50 | — | 0.05 | 1.25 | — | 3.65 | .05 - .55B |
| Illium G | 56 | 22.5 | 6.4 | 6.5 | 0.65 | — | 0.20 | 1.25 | — | 6.50 | |
| Illium R | 68 | 21 | 5.0 | 3.0 | 0.70 | — | 0.05 | 1.25 | — | 1.0 | |
| Illium S | 85 | — | — | 3.0 | 9.0 | — | 0.10 | 0.90 | — | 2 | |
| Worthite | 24 | 20 | 3 | 1.75 | 3.50 | — | 0.07 | 1.00 | — | 46.68 | |
| Inconel 625 | 58 | 22 | 10 | — | 0.30 | — | 0.08 | 0.30 | — | 5.52 | 3.8 Ta + Cb |
| Duriron | — | — | — | — | 14.5 | — | 0.50 | 0.50 | — | 84.5 | |
| Sr II A | 15 | 13 | 6.5 | 6.5 | 0.70 | — | 0.04 | 1.00 | — | 57.56 | |
| Ni-O-Nel | 40 | 21 | 3 | 1.8 | 0.50 | — | 0.05 | 0.50 | — | 33.15 | |
| Marker SN42 | 42 | 18 | 5 | 2 | 0.70 | — | 0.05 | 0.70 | — | 31.55 | |
| CF-8M | 12 | 20 | 2.5 | — | 1.00 | — | 0.05 | 1.00 | — | 63.45 | |
| CF 8 | 8 | 18 | — | — | 0.50 | — | 0.07 | 0.50 | — | 72.93 | |
| Chlorimet 2 | 63 | — | 32 | — | 0.70 | — | 0.10 | 0.70 | — | 3.5 | |
| Monel | 67 | — | — | 30 | 0.10 | — | 0.15 | 1.00 | — | 1.75 | |
| Inconel | 76 | 15.5 | — | .2 | 0.25 | — | 0.08 | 0.25 | — | 7.72 | |
| Stellite No. 25 | 10 | 20 | — | — | 0.50 | 15 | 0.10 | 0.70 | 50 | | |
| Carp 20 | 30 | 20 | 3 | 4 | — | — | — | — | — | 42.95 | |
| Carp 20 Cb 3 | 32.5 | 20 | 2 | 3 | 0.5 | — | 0.03 | 0.5 | — | 40.47 | 0.5 Nb ; 0.5 Ti |
| CF8M + 3.5 % Cu | 12.0 | 20.0 | 2.5 | 3.5 | .5 | — | .05 | — | — | 61.45 | |
| Copper Ph 55B | 9.0 | 20.0 | 5.0 | 3.5 | 1.5 | — | .05 | — | — | 60 | |
| Copper PH 55C | 9.0 | 20.0 | 4.0 | 3.0 | 3.5 | — | .05 | — | — | 60 | |
| Marker SN 18 | 20.0 | 18.0 | 2.0 | 2.0 | .5 | — | .07 | — | — | 57 | |
| SSSR Alloy | 23.0 | 23.7 | 2.8 | 3.2 | .5 | — | .07 | — | — | 46.73 | |
| Marker SN 25 | 25.0 | 20.0 | 3.0 | 2.0 | .5 | — | .07 | — | — | 48.73 | |

EXAMPLE 2

Comparative corrosion tests were run in 25% by weight sulfuric acid solution at 176° F.

Disc samples of a number of alloys were prepared having the same dimensions as the discs prepared in Example 1. Residual mechining oil and dirt were removed from all of the sample discs by cleaning them with a small amount of carbon tetrachloride. The discs were then rinsed in water and dried.

Each disc was weighed to the nearest 10,000th of a gram and then suspended in a beaker by a piece of thin platinum wire hooked through the center hole of the disc and attached to a glass rod which rested on the top of the beaker. Sufficient 25% sulfuric acid solution was then added to the beaker so that the entire sample was surrounded. The temperature of the acid was thermostatically controlled at 176° F. by a means of a water bath and each beaker was covered with a watch glass to minimize evaporation.

After precisely 6 hours, the sample discs were removed from the sulfuric acid solution and cleaned of corrosion products. Most samples were cleaned sufficiently with a small nylon bristle brush and tap water. Those samples on which the corrosion product was too heavy for removal with a nylon brush were cleaned with a 1-to-1 solution of hydrochloric acid and water. After the corrosion products had been removed, each disc was again weighed to the nearest 10,000th of a gram. The corrosion rate of each disc, in inches per year, was calculated by the following formula in accordance with ASTM specification G1-67.

$$R_{ipy} = 0.3937 \frac{W_o - W_f}{ATD} \text{ where}$$

where $R_{ipy}$ = corrosion rate in inches per year
$W_o$ = original weight of sample
$W_f$ = final weight of sample
A = area of sample in square centimeters
T = duration of test in years
D = density of alloy in. g/cc.

Results of this corrosion test are set forth in Table 5.

TABLE 5

CORROSION RATES IN 25% $H_2SO_4$ SOLUTION AT 176° F.

| Alloy No. | Loss in Inches of Penetration Per Year (I.P.Y.) |
|---|---|
| 1 | 0.0126 |
| 2 | 0.0186 |
| 3 | 0.0126 |
| 4 | 0.0108 |
| 5 | 0.0092 |
| 6 | 0.0127 |
| 7 | 0.0135 |
| 8 | 0.0108 |
| 9 | 0.0130 |
| 10 | 0.026 |
| 11 | 0.0216 |
| 12 | 0.01025 |
| 13 | 0.0027 |
| 14 | 0.0065 |
| 20 | 0.0146 |
| 21 | 0.0103 |
| 22 | 0.0046 |
| 23 | 0.0133 |
| 24 | 0.0123 |
| Hastelloy A | 0.020 |
| Illium R | 0.007 |
| Durimet 20 | 0.020 |
| Inconel 625 | 0.010 |
| Duriron | 0.048 |
| Marker SM 42 | 0.0158 |
| Nickel | 0.083 |
| Worthite | 0.020 |
| Chlorimet 2 | 0.014 |
| Hastelloy F | 0.060 |
| Hastelloy C | 0.016 |

EXAMPLE 3

Comparative corrosion tests were conducted in 10% sulfuric acid solution at 176° F. Sample discs were prepared and tested in the manner described in Example 2 except that a test solution of 10% sulfuric acid was utilized and the temperature was maintained at 176° F. The results of this test are set forth in Table 6.

TABLE 6

CORROSION RATES IN 10% $H_2SO_4$ SOLUTION AT 176° F.

| Alloy No. | Loss in Inches of Penetration Per Year (I.P.Y.) |
|---|---|
| 1 | 0.021 |
| 2 | 0.0144 |
| 3 | 0.026 |
| 4 | 0.0093 |
| 5 | 0.017 |
| 6 | 0.082 |
| 7 | 0.021 |
| 8 | 0.026 |
| 9 | 0.0151 |
| 10 | 0.019 |
| 11 | 0.019 |
| 12 | 0.022 |
| 13 | 0.0027 |
| 14 | 0.0050 |
| 20 | 0.0157 |
| 21 | 0.0176 |
| 22 | 0.0092 |
| 23 | 0.0116 |
| 24 | 0.0043 |
| Hastelloy A | 0.0036 |
| Hastelloy B | 0.003 |
| Durimet 20 | 0.005 |
| SR II A 1132 | 0.004 |
| Illium G | 0.0051 |
| Hastelloy D | 0.0050 |
| Nickel | 0.0120 |
| CF-8M | 0.197 |
| Worthite | 0.063 |
| Hi-O-Nel | 0.020 |
| CF 8 | 4.5 |
| Monel | 0.009 |
| Hastelloy C | 0.003 |

EXAMPLE 4

Comparative corrosion tests were conducted in boiling 10% sulfuric acid solution.

Sample discs, prepared and weighed in the manner described in Example 1, were suspended in beakers resting on a hot plate and containing boiling 10% sulfuric acid. To insure exposure of the test discs to sulfuric acid solutions of a substantially constant strength, frequent substitutions of beakers containing fresh boiling acid were made.

After precisely 6 hours, the test discs were removed from the boiling acid solutions and the corrosion products removed in the manner described in Example 2. The discs were then weighed and the respective corrosion rates calculated in the manner described in Example 2. The results of this test are set forth in Table 7.

TABLE 7

CORROSION RATES IN BOILING 10% $H_2SO_4$ SOLUTION

| Alloy No. | Loss in Inches of Penetration Per Year (I.P.Y.) |
|---|---|
| 1 | 0.0433 |
| 2 | 0.0515 |
| 3 | 0.0256 |
| 4 | 0.0469 |
| 5 | 0.0235 |
| 6 | 0.0297 |
| 7 | 0.0305 |
| 8 | 0.0363 |
| 9 | 0.0197 |
| 10 | 0.0270 |
| 11 | 0.0297 |
| 12 | 0.0377 |
| 13 | 0.01187 |
| 14 | 0.0216 |
| 15 | 0.0350 |
| 16 | 0.0539 |
| 17 | 0.0270 |
| 20 | 0.0302 |
| 22 | 0.0171 |
| 23 | 0.0253 |
| 24 | 0.0227 |
| 25 | 0.0377 |

TABLE 7-continued

| CORROSION RATES IN BOILING 10% $H_2SO_4$ SOLUTION | |
|---|---|
| Alloy No. | Loss in Inches of Penetration Per Year (I.P.Y.) |
| Inconel | 0.39 |
| CF-8M | 0.86 |
| Nickel | 0.12 |
| Hastelloy F | 0.097 |
| Hastelloy C | 0.047 |
| Inconel 625 | 0.043 |
| Durimet 20 | 0.037 |
| Hastelloy A | 0.036 |
| Worthite | 0.031 |
| CF 8 | 16.5 |
| Stellite No. 25 | 0.092 |

EXAMPLE 5

Comparative corrosion tests were conducted in boiling 40% sulfuric acid solution. The corrosion test discs were prepared and tested in accordance with the method described in Example 4 except that boiling 40% sulfuric acid was used in place of a boiling 10% sulfuric acid solution. The results of this test are set forth in Table 8.

TABLE 8

| CORROSION RATES IN BOILING 40% $H_2SO_4$ SOLUTION | |
|---|---|
| Alloy No. | Loss in Inches of Penetration Per Year (I.P.Y.) |
| 1 | 0.1950 |
| 2 | 0.0867 |
| 3 | 0.3371 |
| 4 | 0.0221 |
| 5 | 0.2142 |
| 6 | 0.2123 |
| 8 | 0.1002 |
| 11 | 0.1927 |
| 14 | 0.0345 |
| 20 | 0.0459 |
| 21 | 0.0370 |
| 23 | 0.0566 |
| 24 | 0.0365 |
| Carpenter 20 | 0.0572 |
| Hastelloy C | 0.15 |
| Hastelloy F | 0.48 |
| Monel | 0.65 |
| Nickel | 3.4 |
| CF8M Stainless | 2.5 |

EXAMPLE 6

Comparative corrosion tests were conducted in 65–68% nitric acid solution at 150° F. Corrosion sample discs were prepared and tested in the manner described in Example 2 except that a test solution of 65–68% nitric acid solution at 150° F. was used. The results of this test are set forth in Table 9.

TABLE 9

| CORROSION RATES IN 65–68% $HNO_3$ SOLUTION AT 150° F. | |
|---|---|
| Alloy No. | Loss in Inches of Penetration Per Year (I.P.Y.) |
| 1 | 0.0636 |
| 2 | 0.0688 |
| 3 | 0.0266 |
| 4 | 0.0216 |
| 5 | 0.0527 |
| 6 | 0.0491 |
| 12 | 0.0351 |
| 13 | 0.0448 |
| 16 | 0.015 |
| 24 | 0.0076 |
| Nickel | No resistance |
| Monel | No resistance |
| Hastelloy A | No resistance |
| Hastelloy B | No resistance |
| Chlorimet 2 | No resistance |

TABLE 9-continued

| CORROSION RATES IN 65–68% $HNO_3$ SOLUTION AT 150° F. | |
|---|---|
| Alloy No. | Loss in Inches of Penetration Per Year (I.P.Y.) |
| Hastelloy C | 0.077 |

EXAMPLE 7

Comparative corrosion tests were conducted in 25% sulfuric acid solution at room temperature. Corrosion sample discs were prepared and tested in the manner described in Example 2 except that a 25% sulfuric acid solution at room temperature was used as the test solution and the test period was 144 hours instead of 6 hours. The results of this test are set forth in Table 10.

TABLE 10

| CORROSION RATES IN 25% $H_2SO_4$ SOLUTION AT ROOM TEMPERATURE | |
|---|---|
| Alloy No. | Loss in Inches of Penetration Per Year (I.P.Y.) |
| 1 | 0.00095 |
| 2 | 0.00045 |
| 3 | 0.00125 |
| 4 | 0.00018 |
| 5 | 0.00484 |
| 6 | 0.00314 |
| 7 | 0.00011 |
| 8 | 0.00440 |
| 9 | 0.00366 |
| 10 | 0.00307 |
| 12 | 0.00037 |
| 13 | 0.00101 |
| 14 | 0.00034 |
| 15 | 0.00010 |
| 16 | 0.00033 |
| 17 | 0.00018 |
| 18 | 0.00045 |
| 19 | 0.00090 |
| Hastelloy A | 0.00156 |
| Hastelloy B | 0.001 |
| Hastelloy C | 0.0002 |
| Hastelloy D | 0.001 |
| Monel | 0.005 |
| Nickel | 0.004 |
| CF 8 | 0.088 |
| CF-8M | 0.046 |

EXAMPLE 8

Comparative corrosion tests were conducted in a boiling solution containing 5% by weight nitric acid and 10% by weight sulfuric acid. The corrosion sample discs were prepared and tested in the manner described in Example 4 except that a boiling solution containing 5% by weight nitric acid and 10% by weight sulfuric acid was used as the test solution. The results of this test are set forth in Table 11.

TABLE 11

| CORROSION RATES IN BOILING 10% $H_2SO_4$ PLUS 5% $HNO_3$ | |
|---|---|
| Alloy No. | Loss in Inches of Penetration Per Year (I.P.Y.) |
| 2 | 0.307 |
| 3 | 0.090 |
| 4 | 0.0116 |
| 7 | 1.513 |
| 9 | 90.4 |
| 11 | 32.3 |
| 12 | 0.0272 |
| 13 | 0.058 |
| 14 | 0.135 |
| 21 | 0.070 |
| 22 | 89.5 |
| 23 | .100 |
| 24 | 0.0122 |

TABLE 11-continued

| CORROSION RATES IN BOILING 10% $H_2SO_4$ PLUS 5% $HNO_3$ | |
|---|---|
| Alloy No. | Loss in Inches of Penetration Per Year (I.P.Y.) |
| Carp 20 | 0.0150 |

As these results indicate, the alloys of the invention provide very satisfactory corrosion resistance even in environments containing relatively strong oxidizing agents provided that the chromium content of the alloy is 12% by weight or more.

EXAMPLE 9

Comparative corrosion tests were conducted in boiling mixed acid solutions containing 5% by weight nitric acid and varying proportions of sulfuric acid ranging from 10% by weight to 50% by weight. Corrosion test discs were prepared and tested in accordance with the method described in Example 4 except that boiling mixed acid solutions were used in place of boiling 10% sulfuric acid. The results of this test are set forth in Table 12.

TABLE 12

| CORROSION RATES IN INCHES PER YEAR (I.P.Y.) AT 80° C. (176° F.) FOR SEVERAL CONCENTRATIONS OF $H_2SO_4$ PLUS 5% $HNO_3$ IN WATER SOLUTIONS | | | | |
|---|---|---|---|---|
| Alloy No. | 10% $H_2SO_4$ | 25% $H_2SO_4$ | 40% $H_2SO_4$ | 50% $H_2SO_4$ |
| 4 | 0.0046 | 0.0057 | 0.0089 | 0.0108 |
| 12 | 0.0305 | 0.0362 | 0.0473 | 0.0848 |
| 13 | 0.0335 | 0.0259 | 0.0410 | 0.0675 |
| 20 | 0.4622 | 0.1026 | 0.1829 | 0.3267 |
| 24 | 0.0038 | 0.0014 | 0.0068 | 0.0119 |

EXAMPLES 10 AND 11

Comparative corrosion tests were run in 10% hydrochloric acid and 20% hydrochloric acid, respectively, at room temperature. Corrosion sample discs were prepared and tested in the manner described in Example 2 except that the test solution for Example 10 was 10% hydrochloric acid at room temperature and the test solution for Example 11 was 20% hydrochloric acid at room temperature. The results of these tests are set forth in Tables 13 and 14.

TABLE 13

| CORROSION RATES IN 10% HCl SOLUTION AT ROOM TEMPERATURE | |
|---|---|
| Alloy No. | Loss in Inches of Penetration Per Year (I.P.Y.) |
| 1 | 0.0224 |
| 2 | 0.0295 |
| 3 | 0.0195 |
| 4 | 0.0027 |
| 5 | 0.0110 |
| 6 | 0.0120 |
| 7 | 0.0054 |
| 8 | 0.0054 |
| 9 | 0.00892 |
| 10 | 0.011 |
| 11 | 0.0081 |
| 14 | 0.011 |
| 20 | 0.0068 |
| 21 | 0.0122 |
| 22 | 0.0119 |
| 23 | 0.0100 |
| 24 | 0.0124 |
| Durimet 20 | 0.027 |
| Hastelloy F | 0.010 |
| Hastelloy A | 0.0144 |
| Hastelloy B | 0.0062 |
| Hastelloy C | 0.0263 |
| CF 8 | 0.084 |

TABLE 14

| CORROSION RATES IN 20% HCl SOLUTION AT ROOM TEMPERATURE | |
|---|---|
| Alloy No. | Loss in Inches of Pentration Per Year (I.P.Y.) |
| 1 | 0.1001 |
| 2 | 0.0243 |
| 3 | 0.0243 |
| 4 | 0.0041 |
| 5 | 0.0054 |
| 6 | 0.016 |
| 7 | 0.011 |
| 8 | 0.030 |
| 9 | 0.0100 |
| 10 | 0.00297 |
| 11 | 0.0035 |
| 12 | 0.0167 |
| 13 | 0.0118 |
| 14 | 0.0081 |
| 20 | 0.0068 |
| 21 | 0.0122 |
| 22 | 0.0119 |
| 23 | 0.0100 |
| 24 | 0.0124 |
| Durimet 20 | 0.012 |
| Hastelloy A | 0.00695 |
| Hastelloy B | 0.0036 |
| Hastelloy C | 0.0144 |
| Hastelloy D | 0.0299 |
| CF 8 | 1.22 |

EXAMPLE 12

Corrosion tests were conducted in boiling 25% sulfuric acid solution. The corrosion test discs were prepared and tested in accordance with the method described in Example 4 except that boiling 25% sulfuric acid was used in place of boiling 10% sulfuric acid. The results of this test are set forth in Table 15.

TABLE 15

| CORROSION RATES IN BOILING 25% $H_2SO_4$ | |
|---|---|
| Alloy No. | Loss in Inches of Penetration Per Year (I.P.Y.) |
| 9 | 0.0227 |
| 20 | 0.0273 |
| 21 | 0.0089 |
| 22 | 0.0000 |
| 23 | 0.0281 |
| 24 | 0.022 |

EXAMPLE 13

Corrosion tests were conducted in 50% sulfuric acid and 176° F. Corrosion sample discs were prepared and tested in the manner described in Example 2 except that the test solution was 50% sulfuric acid at 176° F. Results of this test are set forth in Table 16.

TABLE 16

| CORROSION RATES IN 50% $H_2SO_4$ AT 176° F. | |
|---|---|
| Alloy No. | Loss in Inches of Penetration Per Year (I.P.Y.) |
| 1 | 0.0043 |
| 2 | 0.0089 |
| 3 | 0.0084 |
| 4 | 0.0062 |
| 5 | 0.0081 |
| 6 | 0.0087 |
| 7 | 0.0105 |
| 8 | 0.0092 |
| 9 | 0.0078 |
| 10 | 0.0065 |
| 11 | 0.0124 |
| 12 | 0.0127 |
| 13 | 0.0070 |
| 20 | 0.0032 |
| 21 | 0.0049 |
| 22 | 0.0000 |
| 23 | 0.0041 |

TABLE 16-continued

| CORROSION RATES IN 50% $H_2SO_4$ AT 176° F. | |
|---|---|
| Alloy No. | Loss in Inches of Penetration Per Year (I.P.Y.) |
| 24 | 0.0073 |

EXAMPLE 14

Corrosion tests were conducted in 93% sulfuric acid at 176° F. Corrosion sample discs were prepared and tested in the manner described in Example 2 except that the test solution was 93% sulfuric acid at 176° F. The results of this test are set forth in Table 17.

TABLE 17

| CORROSION RATES IN 93% $H_2SO_4$ SOLUTION AT 176° F. | |
|---|---|
| Alloy No. | Loss in Inches of Penetration Per Year (I.P.Y.) |
| 4 | 0.0070 |
| 9 | 0.3175 |
| 21 | 0.011 |
| 22 | 0.233 |
| 23 | 0.017 |
| 24 | 0.0046 |
| Carpenter 20 | 0.020 |
| Carpenter 20 Cb3 | 0.020 |
| Worthite | 0.065 |

EXAMPLE 15

Corrosion tests were conduted at 176° F. in sulfuric acid solutions having strengths of 40%, 50%, 60% and 70%, respectively. Corrosion sample discs were prepared and tested in the manner described in Example 2 except that the aforesaid series of conditions were utilized. The results of this test are set forth in Table 18.

TABLE 18

| CORROSION AT 176° F. IN $H_2SO_4$ SOLUTIONS OF CONCENTRATIONS INDICATED BELOW, INCHES PER YEAR ATTACK (I.P.Y.) | | | | |
|---|---|---|---|---|
| Alloy No. or Name | 40% | 50% | 60% | 70% |
| CF8M + 3.5% Cu | 0.21 | 0.75 | 0.95 | 0.40 |
| Cooper Ph55B | >0.6 | >1 | >1 | 0.30 |
| Cooper PH55C | >0.6 | >1 | >1 | 0.075 |
| Marker SN 18 | 0.040 | 0.040 | 0.040 | 0.040 |
| Worthite | 0.018 | 0.025 | 0.035 | >0.050 |
| SSSR Alloy | 0.010 | 0.018 | 0.034 | 0.050 |
| Marker SN 25 | 0.016 | 0.020 | 0.040 | 0.040 |
| Carpenter 20 | 0.022 | 0.017 | 0.025 | 0.034 |
| Marker SN 42 | 0.010 | 0.018 | 0.023 | 0.040 |
| Illium G | 0.006 | 0.006 | 0.005 | 0.075 |
| Inconel 625 | 0.014 | 0.017 | 0.028 | 0.064 |
| Monel | 0.053 | 0.043 | 0.040 | 0.065 |
| 1 | 0.0189 | 0.0043 | 0.0078 | 0.0046 |
| 2 | 0.0157 | 0.0089 | 0.0114 | 0.0076 |
| 3 | 0.0122 | 0.0084 | 0.0092 | 0.0051 |
| 4 | 0.0095 | 0.0062 | 0.0054 | 0.0065 |
| 5 | 0.0081 | 0.0068 | 0.0054 | 0.0054 |
| 6 | 0.0178 | 0.0084 | 0.0078 | 0.0065 |
| 7 | 0.0149 | 0.0105 | 0.0089 | 0.0084 |

TABLE 18-continued

| CORROSION AT 176° F. IN $H_2SO_4$ SOLUTIONS OF CONCENTRATIONS INDICATED BELOW, INCHES PER YEAR ATTACK (I.P.Y.) | | | | |
|---|---|---|---|---|
| Alloy No. or Name | 40% | 50% | 60% | 70% |
| 8 | 0.0103 | 0.0092 | 0.0076 | 0.0059 |
| 9 | 0.0029 | 0.0073 | 0.0214 | 0.0073 |
| 10 | 0.0000 | 0.0065 | 0.0000 | 0.0019 |
| 11 | 0.0184 | 0.0124 | 0.0100 | 0.0022 |
| 12 | 0.0203 | 0.0141 | 0.0100 | 0.0092 |
| 13 | 0.0076 | 0.0070 | 0.0067 | 0.0084 |
| 14 | 0.0051 | — | 0.0011 | — |
| 20 | 0.0000 | 0.0051 | 0.0041 | 0.0000 |
| 21 | 0.0043 | 0.0000 | 0.0000 | 0.0051 |
| 22 | 0.0138 | 0.0083 | 0.0092 | 0.0051 |
| 23 | 0.0100 | 0.0100 | 0.0081 | 0.0068 |
| 24 | 0.0000 | 0.0070 | 0.0078 | 0.0043 |

In view of the above, it will be seen that the several objects of the invention are achieved and other advantageous results attained.

As various changes could be made in the above products without departing from the scope of the invention, it is intended that all matter contained in the above description shall be interpreted as illustrative and not in a limiting sense.

What is claimed is:

1. An air-meltable castable alloy, resistant to corrosion by sulfuric acid over a wide range of acid strengths, consisting essentially of between about 34.10 and about 39.33% by weight nickel, between about 12.50 and about 14.29% by weight chromium, between about 5.90 and about 17.89% by weight molybdenum, between about 2.90 and about 5.67% by weight copper, between about 0.10 and about 1.25% by weight silicon, between about 0.003 and about 0.15% by weight carbon, between about 22 and about 29% by weight iron, up to about 3.0% by weight manganese, up to about 9.80% by weight tungsten, up to about 4.68% by weight tantalum, and up to about 3.00% by weight niobium.

2. An alloy as set forth in claim 1 wherein the carbon content is between about 0.01 and about 0.05% by weight, the silicon content is between about 0.05 and about 1.25% by weight, and the molybdenum content, tungsten content, tantalum content and niobium content correspond to the relationships $$X = [Mo] + [W] + [Ta] + [Nb] \text{ and}$$

$$Y = [Mo] + 0.7([W] + [Ta] + [Nb])$$

where

[Mo] = the molybdenum content in % by weight,
[W] = the tungsten content in % by weight,
[Ta] = the tantalum content in % by weight,
[Nb] = the niobium content in % by weight, X is between about 15 and 20% and Y is between about 12.5 and about 17.9%.

3. An alloy as set forth in claim 1 wherein the niobium content is about 3% by weight.

4. An alloy as set forth in claim 1 wherein the niobium content is about 3% by weight and the tantalum content is about 4.68% by weight.

* * * * *

UNITED STATES PATENT AND TRADEMARK OFFICE

CERTIFICATE OF CORRECTION

PATENT NO. : 4,088,478

DATED : May 9, 1978

INVENTOR(S) : John H. Culling

It is certified that error appears in the above-identified patent and that said Letters Patent are hereby corrected as shown below:

Column 1, lines 8-9, "Nov. 30, 1973" should read -- March 30, 1973 --. Column 2, line 13, "streams by" should read -- streams be --.

Signed and Sealed this

*Fifteenth* Day of *April 1980*

[SEAL]

*Attest:*

SIDNEY A. DIAMOND

*Attesting Officer*

*Commissioner of Patents and Trademarks*